US006537107B2

(12) United States Patent
Slack et al.

(10) Patent No.: US 6,537,107 B2
(45) Date of Patent: Mar. 25, 2003

(54) ACCURATE POSITIONING OF SOLDER TAIL LEADS IN AN ELECTRICAL CONNECTOR

(75) Inventors: Victor E. Slack, Lewisville, NC (US); Eric C. Laurer, Clemmons, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/956,330

(22) Filed: Sep. 19, 2001

(65) Prior Publication Data

US 2002/0034896 A1 Mar. 21, 2002

Related U.S. Application Data

(60) Provisional application No. 60/233,809, filed on Sep. 20, 2000.

(51) Int. Cl.[7] ..... H01R 9/09
(52) U.S. Cl. ..... 439/541.5; 439/676
(58) Field of Search ..... 439/79, 80, 752, 439/701, 717, 676, 541.5, 903

(56) References Cited

U.S. PATENT DOCUMENTS 5,066,236 A * 11/1991 Brocksteeg ..... 439/79
6,080,011 A * 6/2000 Tsao et al. ..... 439/54
6,193,560 B1 * 2/2001 Morana et al. ..... 439/676

* cited by examiner

*Primary Examiner*—Renee Luebke
*Assistant Examiner*—Phuongchi T Nguyen

(57) ABSTRACT

An electrical connector includes a housing (30,60,80,100) and a contact insert (41,61,81,101) that includes contacts (43,63,83,103) carried by a molding (42,62,82,102). A lock member (50,70,90,105) cooperates with the housing to secure the contact insert in the housing and to bias the molding against a wall of the housing. In one embodiment, the lock member (50) has a head (52) that is interference fitted in a stall (48) in the housing, and the lock member has a tail (54) that is arranged to urge the molding toward the head. In another embodiment, the lock member (60,80) is wedged between the molding and a portion of the housing. The lock member has a main portion, and nose portions (76,92) that project from the main portion, and the nose portions engage the molding. In another embodiment, the lock member (105) includes a protrusion of the molding that is interference fitted in an aperture (106) in the housing.

6 Claims, 11 Drawing Sheets

ACCURATE POSITIONING OF SOLDER TAIL LEADS IN AN ELECTRICAL CONNECTOR

CROSS-REFERENCE TO RELATED APPLICATION

This application claims the benefit of U.S. Provisional Application No. 60/233,809 filed Sep. 20, 2000.

FIELD OF THE INVENTION

The invention relates to an electrical connector including a housing that holds an array of contacts which are formed as a contact insert, and in particular, to a structure for holding a contact insert accurately in position in a connector housing.

BACKGROUND OF THE INVENTION

An electrical connector housing that holds a number of contacts may have the contacts pre-assembled in the form of a contact insert, or subassembly, that can be installed into the housing as a unit. In a prior art electrical connector as shown in FIGS. 1 and 2, a connector housing 10 holds upper contact inserts 12 and lower contact inserts 22. Each of the contact inserts 12, 22 comprises an array of contacts 13, 23 having portions which are surrounded by a dielectric molding 14, 24, respectively, such that the contacts 13, 23 in each array are held in fixed relative positions. The contacts 13, 23 include mating portions 15, 25 that are engagable with contacts of a mating electrical connector (not shown), and board-mounting portions in the form of solder tails 16, 26 that are arranged for insertion into through-holes in a circuit board (not shown). Pairs of upper and lower contact inserts 12, 22 are installed into the housing 10 through an open rear of the housing, with the molding 14 of the upper contact insert being positioned behind the molding 24 of the lower contact insert. The moldings 14, 24 have rails 17, 27 that are received in channels 28 in the housing 10. Each pair of upper and lower contact inserts 12, 22 is secured in the housing by a molded latch arm 18 of the housing which has a latch tab 19 that engages in a pocket 20 at the rear of the molding 14 of the upper contact insert 12. A problem arises in that dimensional tolerances on the parts permit the contact inserts 12, 22 to have some free play in the connector housing 10, thereby resulting in a positional variation of the solder tails 16, 26 with respect to the connector housing 10. If the positional variation of the solder tails 16, 26 is too great, assembly operations will not be able to insert the solder tails into their respective through-holes in the circuit board. There is a need for a device that will hold the contact inserts accurately in position relative to the connector housing.

SUMMARY OF THE INVENTION

It is an object of the invention to secure a contact insert in a connector housing.

It is another object of the invention to eliminate free play between a contact insert and a connector housing.

It is yet another object of the invention to accurately position contact solder tails relative to a connector housing.

The invention is an electrical connector comprising a dielectric housing and a contact insert carried by the housing, the contact insert including contacts carried by a molding, and a lock member that cooperates with the housing to secure the contact insert in the housing and to bias the molding against a wall of the housing.

According to one embodiment, the lock member has a head that is secured to the housing, and a tail that is arranged to urge the molding toward the head. The head is interference fitted in a stall in the housing, and the stall is open through a board-mounting face of the housing.

According to another embodiment, the lock member is wedged between the molding and a portion of the housing. The lock member has a main portion, and nose portions that project from the main portion, and the nose portions engage the molding.

According to another embodiment, the lock member includes a protrusion of the molding that is interference fitted in an aperture in the housing.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
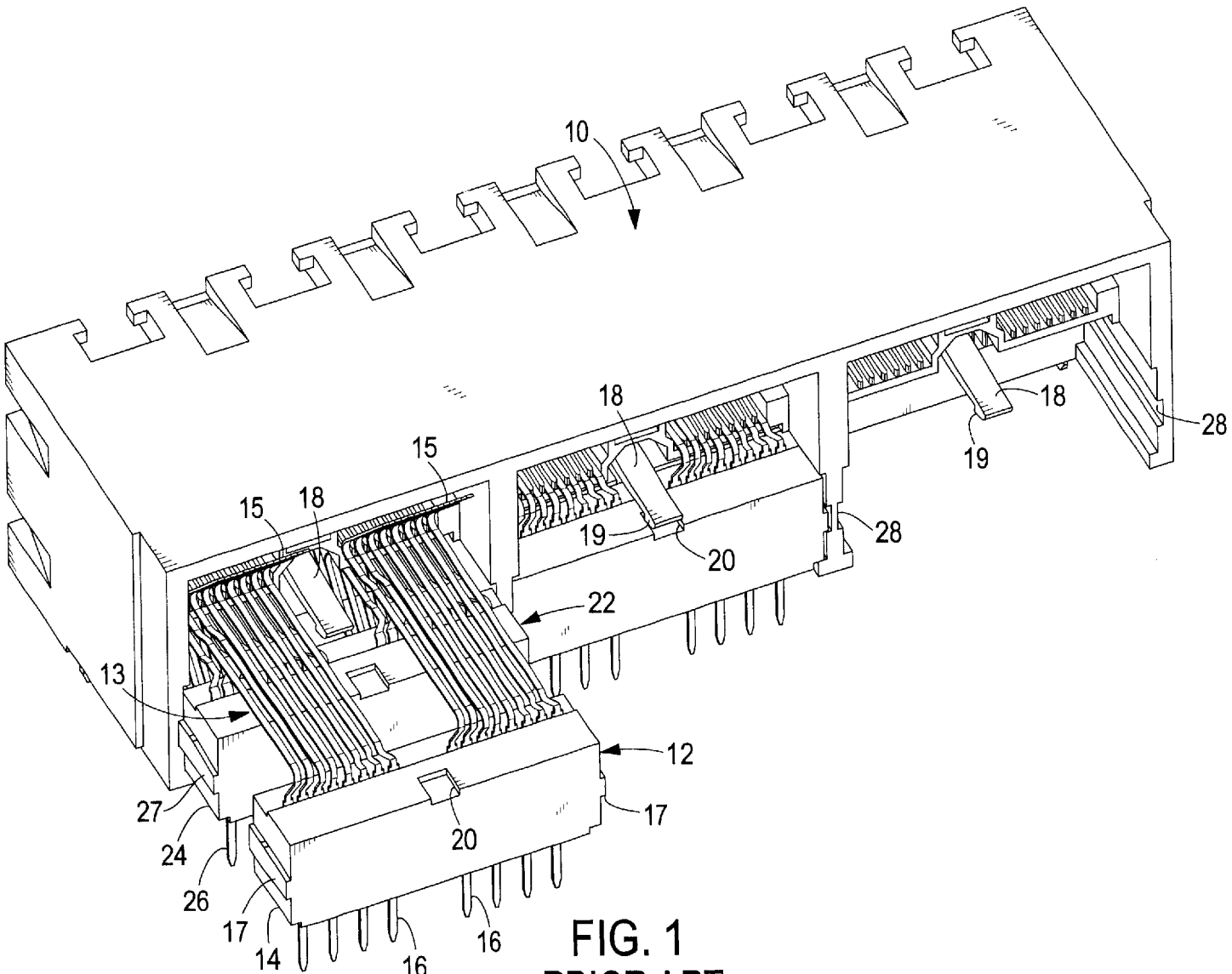
FIG. 1 PRIOR ART
FIG. 1 is a top rear isometric view of a prior art electrical connector.
Figure 2:
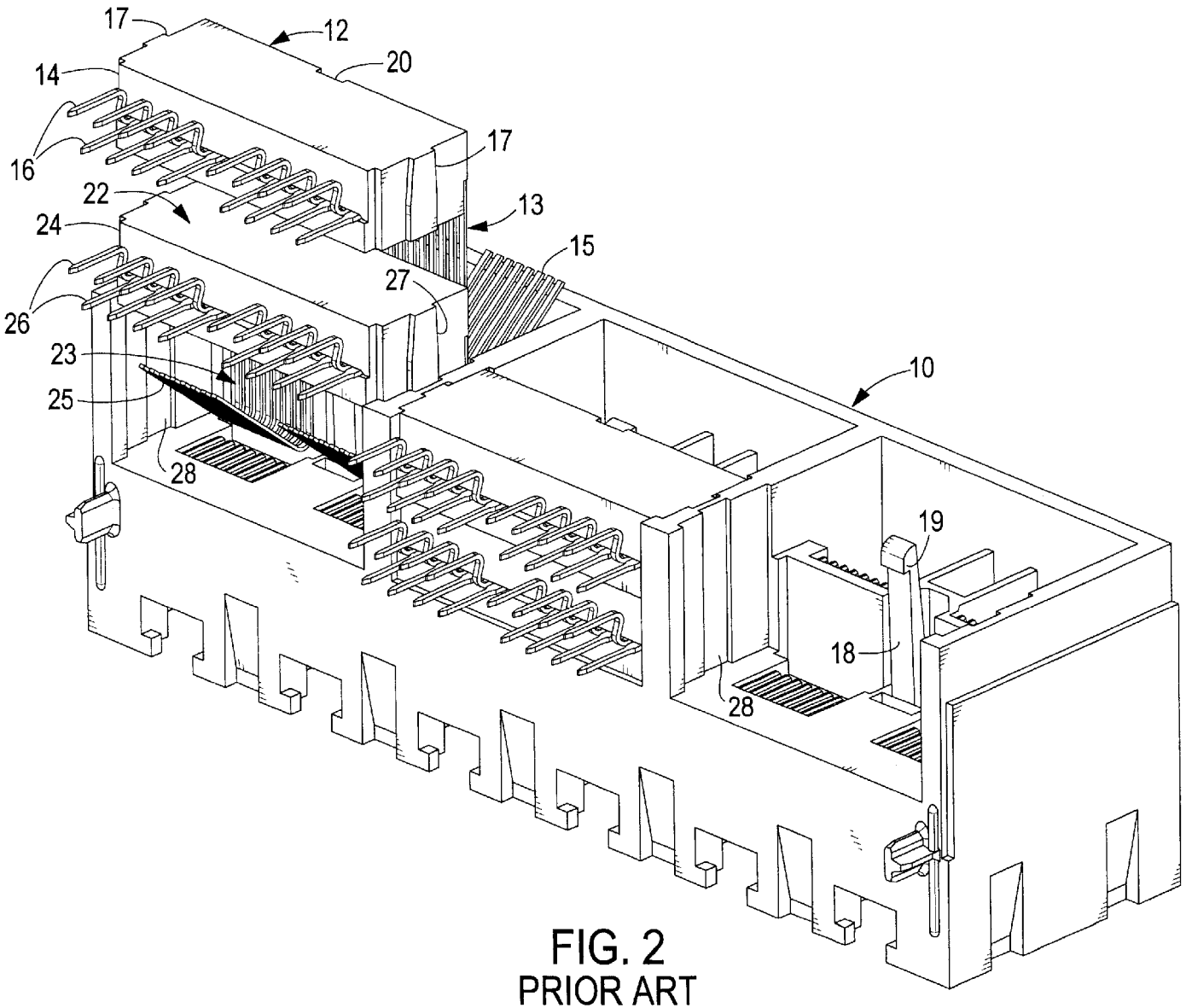
FIG. 2 PRIOR ART
FIG. 2 is a bottom rear isometric view of the prior art electrical connector of FIG. 1.
Figure 3:
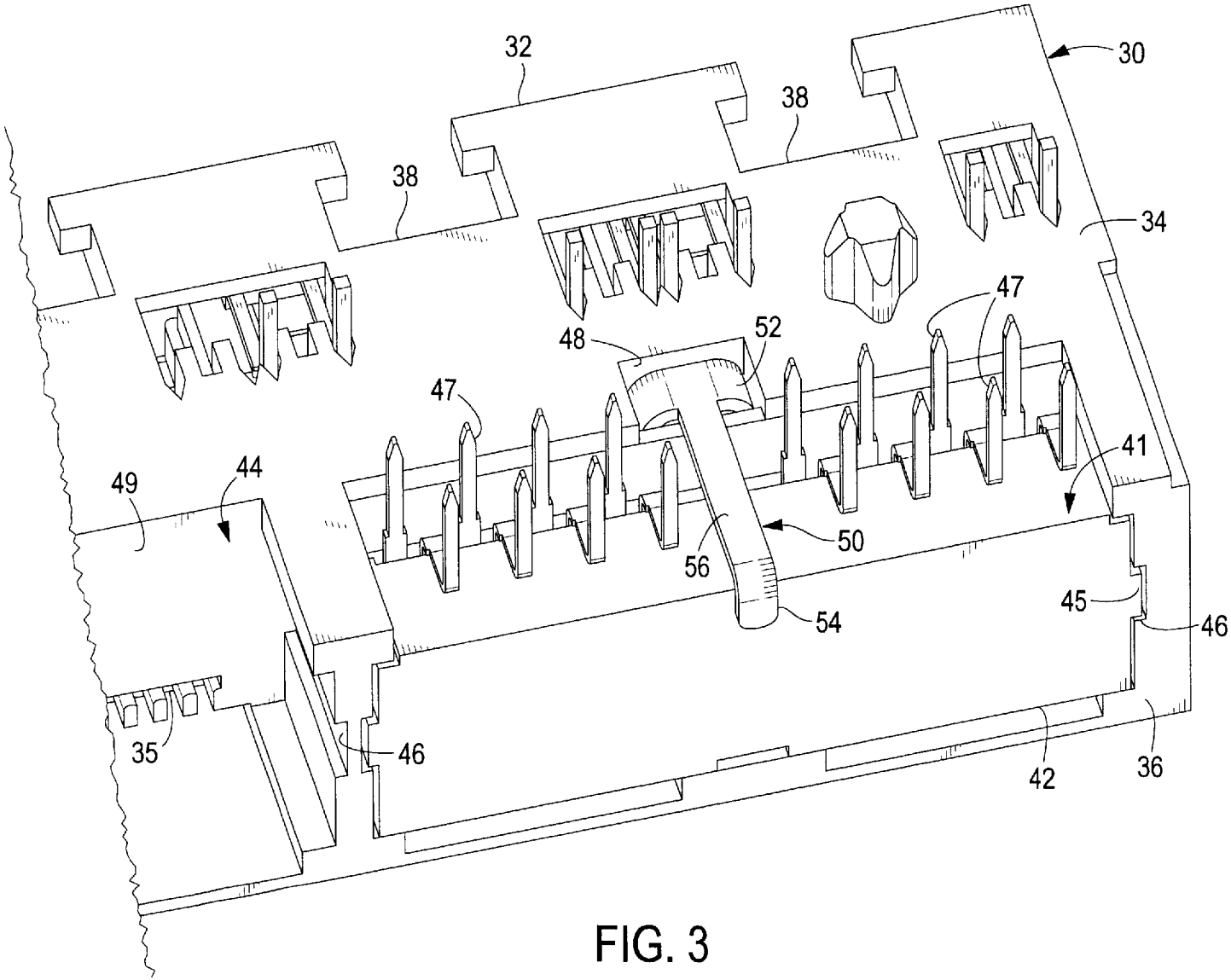
FIG. 3 is a bottom rear isometric view of an electrical connector having a contact insert lock member in one embodiment according to the invention.
Figure 4:
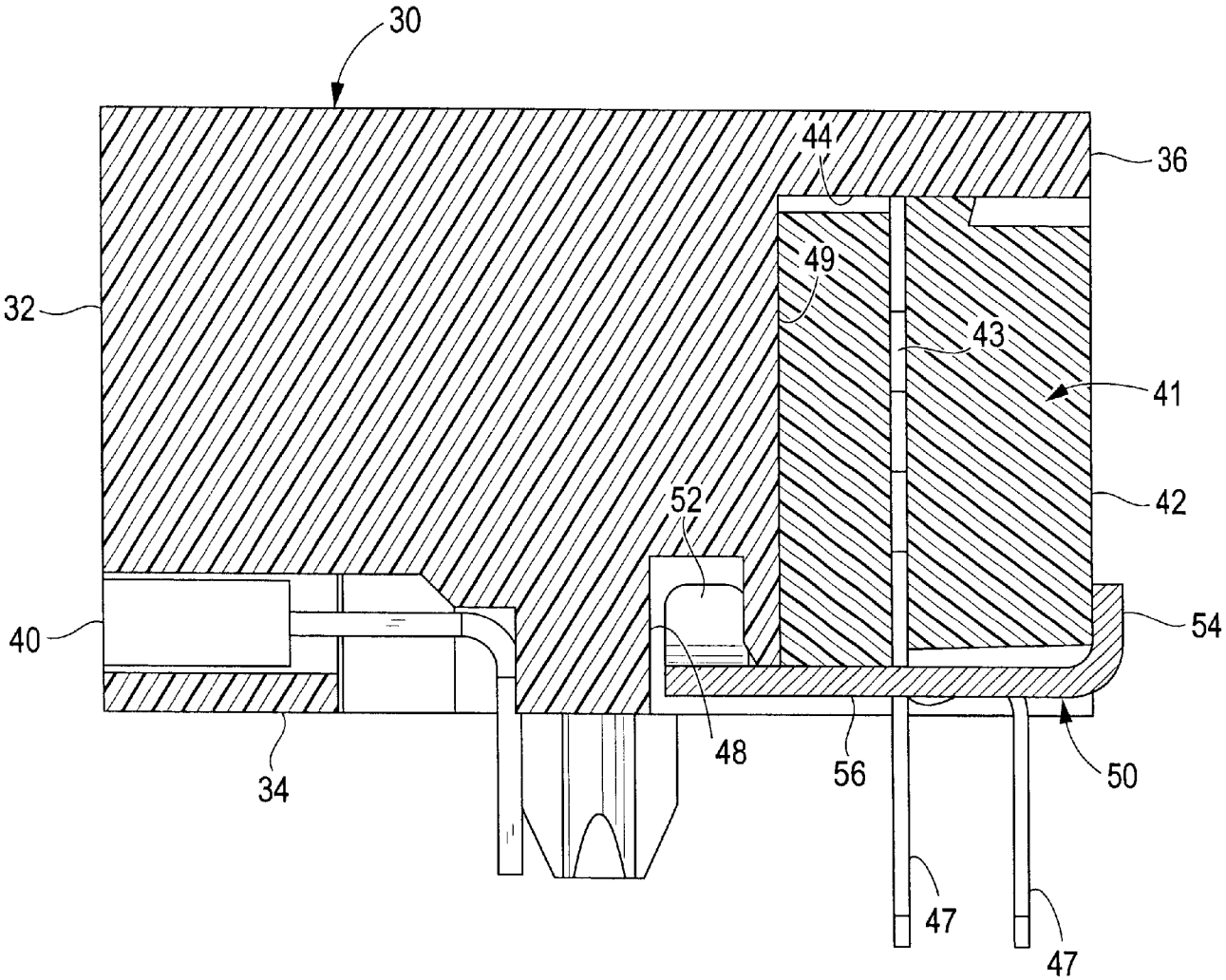
FIG. 4 is a cross-sectional view through the electrical connector of FIG. 3.

In one embodiment as shown in FIGS. 3 and 4, the invention comprises a dielectric housing 30 having a front face 32, a bottom or board-mounting face 34, and a rear face 36. The housing has cavities (not shown) in the front face 32 that are configured as receptacles for mating RJ-type modular plug connectors (not shown). The housing has cutouts 38 in the bottom face 34 which are configured to receive projections on resilient latch arms of the modular plug connectors. The housing may carry visual indicators 40 such as LED's which illuminate to indicate the status of an electrical circuit.

The housing 30 carries a contact insert 41 which includes a molding 42 that holds a plurality of contacts 43. The molding is installed in a chamber 44 that is open through the bottom face 34 and through the rear face 36 of the housing. The molding has guide rails 45 that are slidingly received in channels 46 of the chamber 44. The contacts 43 extend through passages 35 in the housing that connect the chamber 44 with the cavities that are open through the front face 34 of the housing. The contacts 43 have leads in the form of solder tail leads 47 that are receivable in through-holes in a circuit board (not shown).

The housing has a stall 48 that receives a lock member 50 that secures the contact insert 41 to the housing. The lock member 50 has a head portion 52 that is dimensioned to be interference fitted in the stall 48, and a tail portion 54 that is configured to grip the bottom rear edge of the molding 42. The lock member 50 is a discrete article that is preferably made from metal which has been stamped to provide a T-shaped profile and then formed to provide the head portion 52 and the tail portion 54. The head portion 52 is formed by upwardly bending two arms of the T-shaped profile. The tail portion 54 is connected to the head portion 52 by a leg 56. The length of the leg is selected such that when the head portion 52 is fitted in the stall 48, the tail portion 54 will urge the molding 42 against a rearward-facing wall 49 in the chamber 46, thereby eliminating any gap between the molding 42 and the rearward-facing wall 49. In this way, the molding is firmly engaged against the rearward-facing wall of the chamber. The rearward-facing wall 49 has a known accurate position with respect to the housing. Thus, the solder tail leads 47 are accurately positioned relative to the housing, and the solder tail leads will be aligned with their respective through-holes in the circuit board when the housing is properly positioned on the circuit board.

Figure 5:
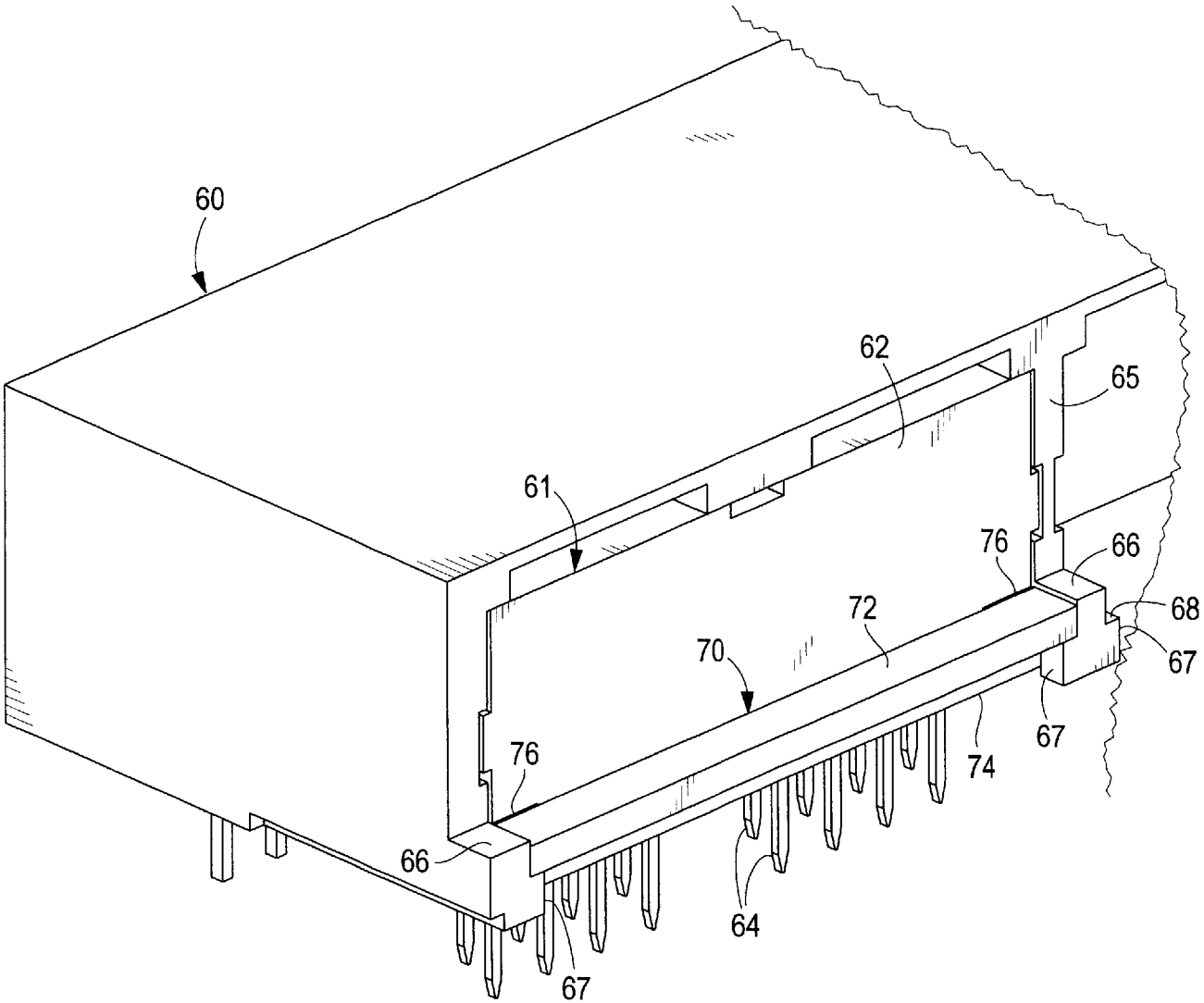
FIG. 5 is top rear isometric view of an electrical connector having a contact insert lock member in a first alternate embodiment according to the invention.
Figure 6:
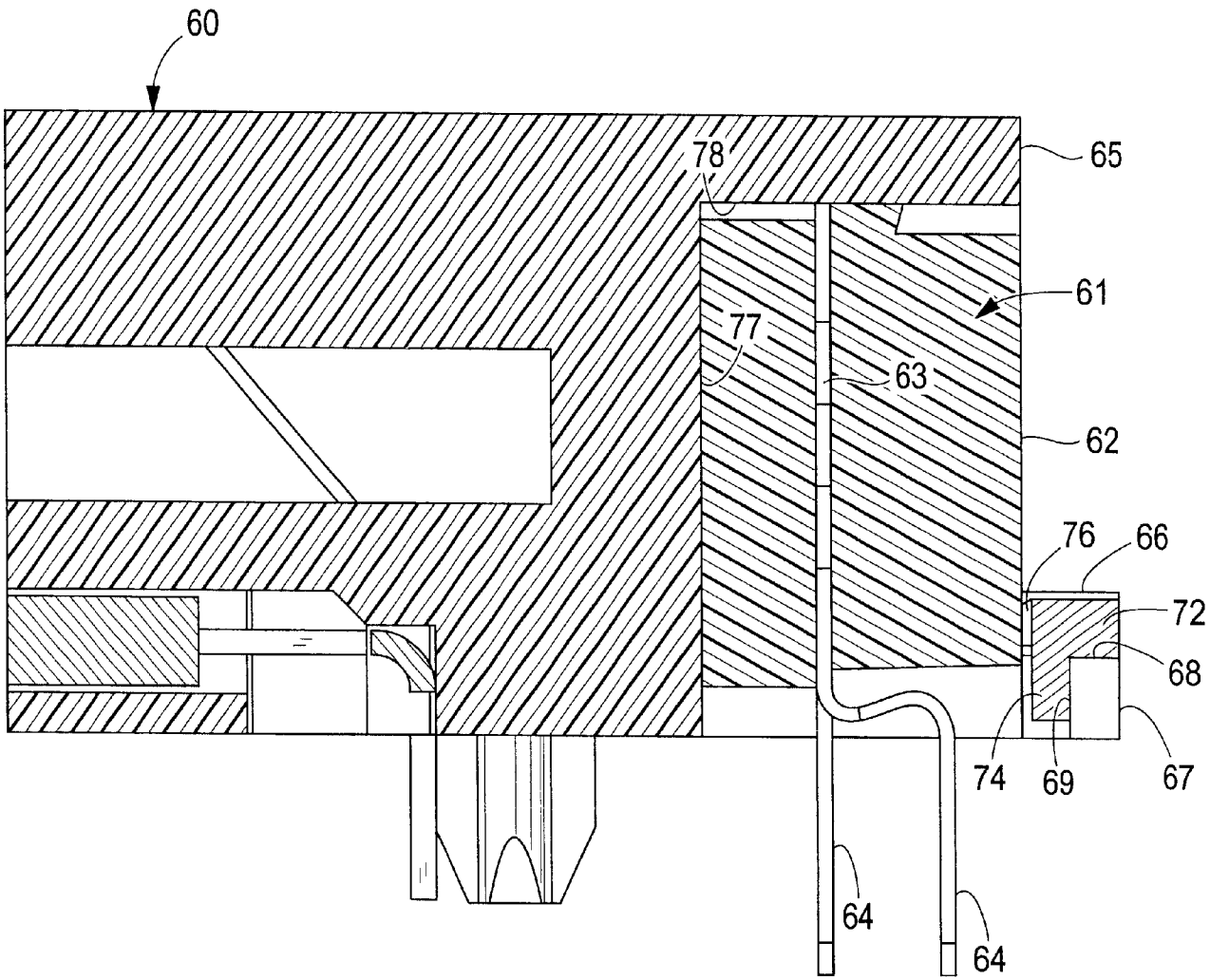
FIG. 6 is a cross-sectional view through the electrical connector of FIG. 5.

Another embodiment of the invention is shown in FIGS. 5 and 6. Connector housing 60 holds a contact insert 61 that includes molding 62 and contacts 63 having solder tail leads 64. The housing 60 has a rear face 65, rearward extensions 66 and lateral lugs 67. Each of the lugs 67 has a top surface that forms a seat 68, and a forward-facing surface 69 that is spaced rearwardly from the molding 62 of the contact insert, as shown in FIG. 6.

A lock member 70 is installed behind the molding 62 of the contact insert. The lock member spans a distance between an opposed pair of the lugs 67. The lock member has a main portion 72 that resides on the seats 68 of the lugs 67, and a projecting portion 74 that is installed in gaps between the forward-facing surfaces 69 and the molding 62. The lock member 70 also has nose portions 76 that are arranged to engage the molding 62 when the projecting portion 74 is engaged against the forward surfaces 69 of the lugs. The lock member 70 is wedged between the molding 62 and the lugs 67 such that the nose portions 76 bias the molding 62 against a rearward-facing wall 77 of a chamber 78 in the housing, thereby accurately positioning the solder tail leads 64 relative to the connector.

Figure 7:
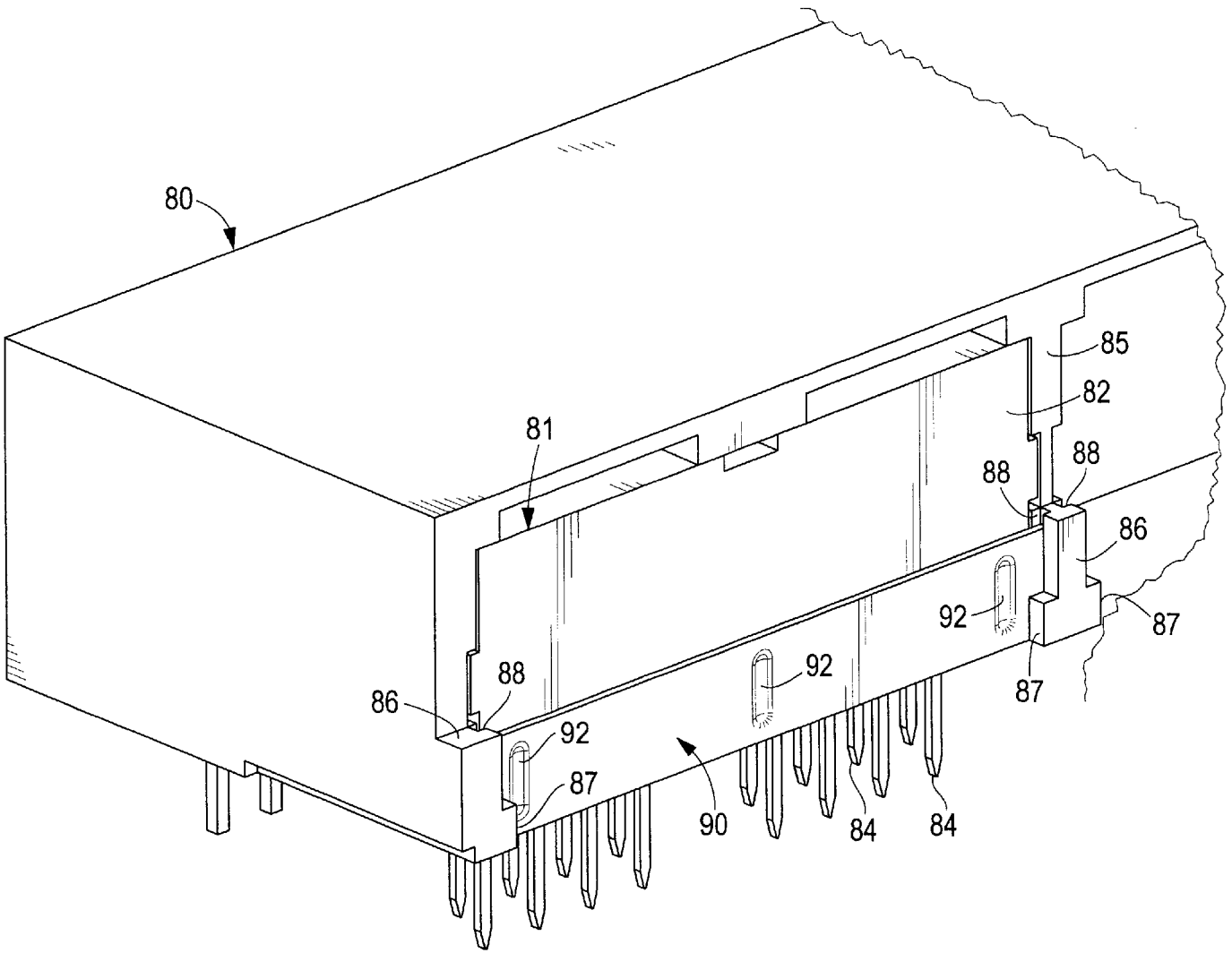
FIG. 7 is a top rear isometric view of an electrical connector having a contact insert lock member in a second alternate embodiment according to the invention.
Figure 8:
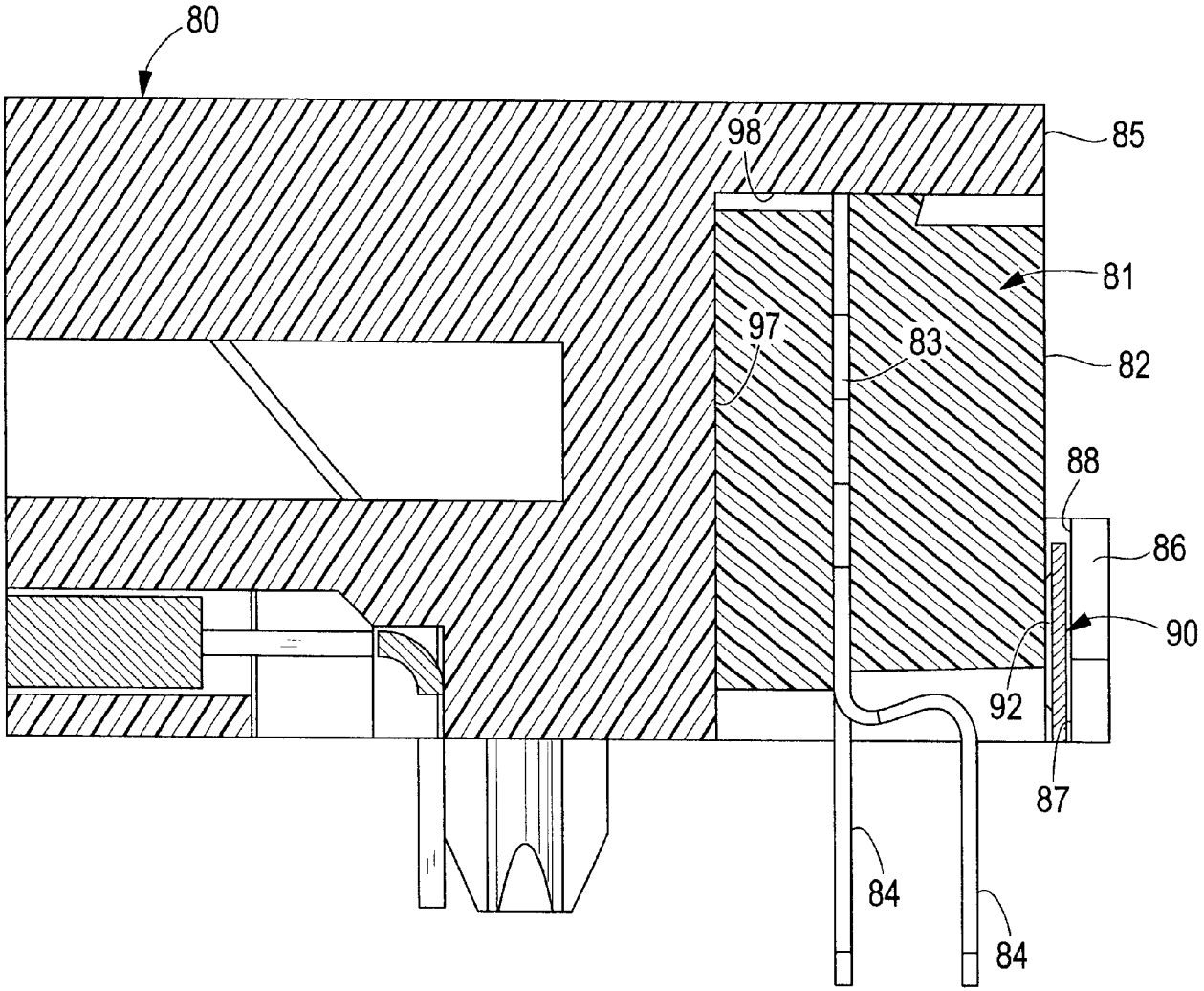
FIG. 8 is a cross-sectional view through the electrical connector of FIG. 7.

Another embodiment of the invention is shown in FIGS. 7 and 8. A connector housing 80 holds a contact insert 81 including a molding 82 and contacts 83 having solder tail leads 84. The connector housing 80 has a rear face 85, rearward extensions 86, and opposed pairs of lugs 87. Slots 88 are formed in the rearward extensions 86 adjacent to the rear face 85. A lock member 90 which is installed behind the molding 82 has end portions which are slidingly received in the slots 88. The lock member is preferably formed from a metallic strip. The lock member has protrusions or nose portions 92 which are arranged to engage the molding 82. The nose portions 92 may be formed as embossments which have been deformed from the plane of the lock member 90. The lock member 90 is wedged in the slots 88 such that the nose portions 92 bias the molding 82 against a rearward-facing wall 97 of a chamber 98 in the connector housing. The nose portions 92 may have any of numerous different shapes in addition to the shape which is shown in the drawings.

Figure 9:
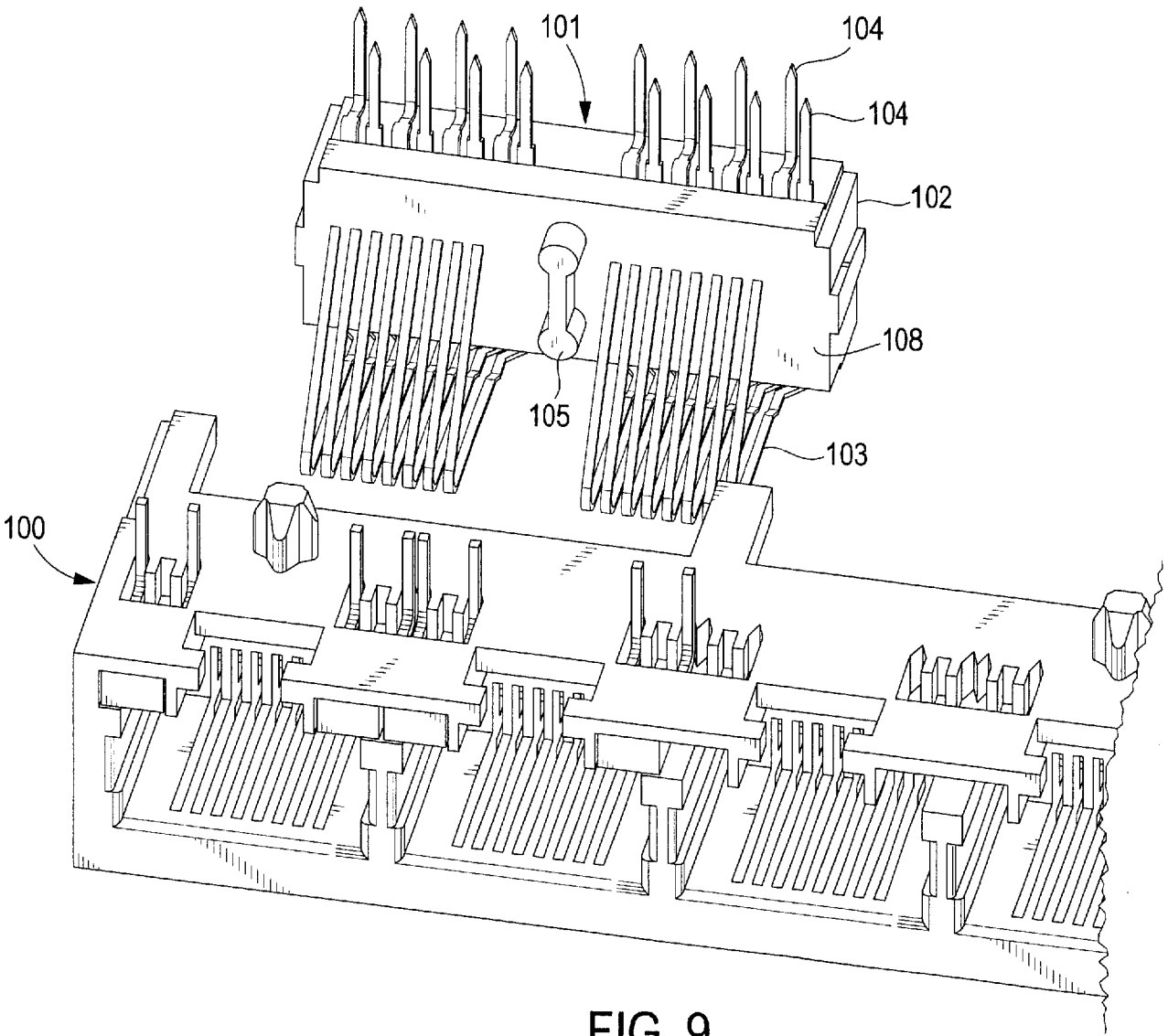
FIG. 9 is a bottom front isometric view of an electrical connector having a contact insert lock member in a third alternate embodiment according to the invention.
Figure 10:
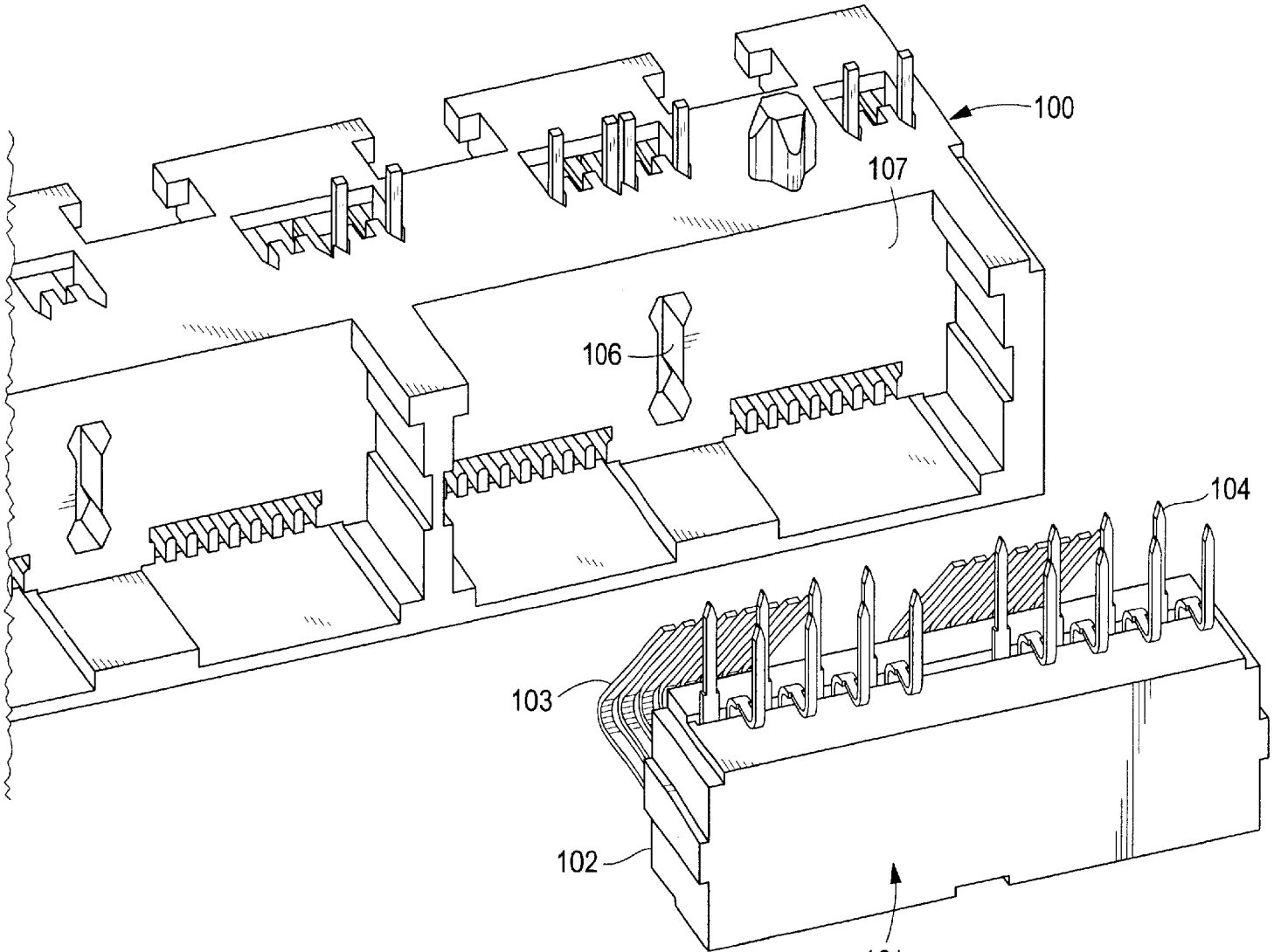
FIG. 10 is a bottom rear isometric view of the electrical connector in FIG. 9.
Figure 11:
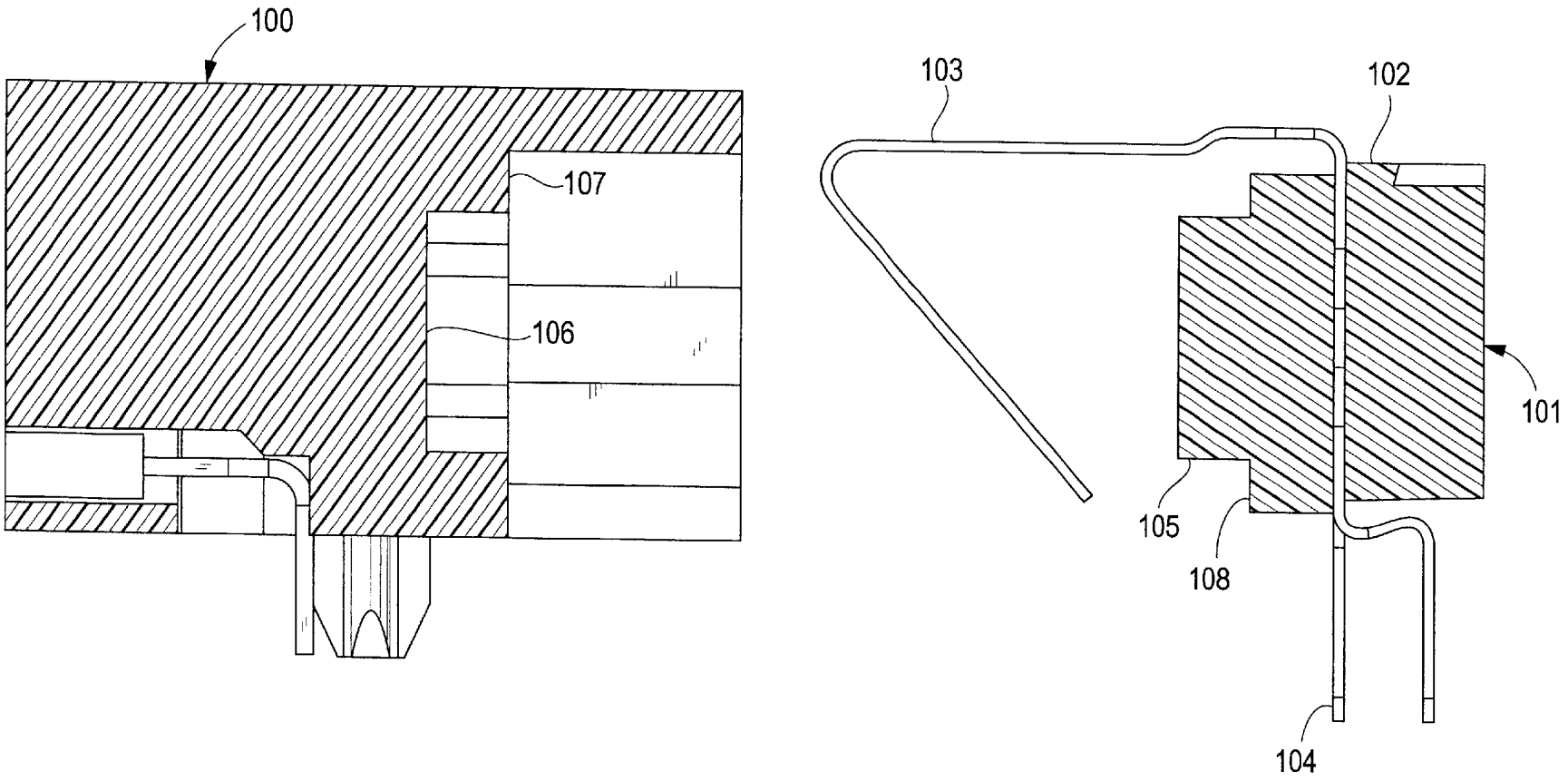
FIG. 11 is a cross-sectional view through the electrical connector of FIG. 9.

Another embodiment of the invention is shown in FIGS. 9–11. A connector housing 100 holds a contact insert 101 including a molding 102 that holds contacts 103 having solder tail leads 104. The molding has a forward facing protrusion 105 which is received in a correspondingly shaped aperture 106 in a rearward-facing wall 107 of the housing. The protrusion 105 is dimensioned for an interference fit within the aperture 106. The interference fit serves to lock the contact insert in a fixed position with a front face 108 of the molding 102 adjacent to the rearward-facing wall 107 of the housing.

A lock member according to the invention has been disclosed in various embodiments, and still other variations may now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An electrical connector comprising:

a dielectric housing having a board-mounting face and a stall that is open through the board-mounting face;

a contact insert carried by the housing, the contact insert including contacts carried by a molding; and a separate lock member having a head that is secured in the stall and a tail that engages the molding to secure the contact insert in the housing and to bias the molding against a wall of the housing.

2. The electrical connector of claim 1 wherein the molding is installed through a rear of the housing and is biased toward a front of the housing by the lock member.

3. The electrical connector of claim 1 wherein the lock member is made of metal.

4. The electrical connector of claim 3 wherein the metal has been stamped to form a T-shaped profile, and arms of the T-shaped profile are bent to form the head of the lock member.

5. The electrical connector of claim 4 wherein the head is interference fitted in the stall.

6. The electrical connector of claim 4 wherein a leg of the T-shaped profile has a free end that is bent to form the tail of the lock member.

* * * * *